US007544081B2

(12) United States Patent
Lim

(10) Patent No.: US 7,544,081 B2
(45) Date of Patent: Jun. 9, 2009

(54) ELECTRIC CONNECTOR

(75) Inventor: Chee Boon Vincent Lim, Singapore (SG)

(73) Assignee: MEA Technologies Pte. Ltd., Singapore (SG)

( * ) Notice: Subject to any disclaimer, the term of this patent is extended or adjusted under 35 U.S.C. 154(b) by 0 days.

(21) Appl. No.: 12/219,493

(22) Filed: Jul. 23, 2008

(65) Prior Publication Data

US 2009/0035981 A1 Feb. 5, 2009

(30) Foreign Application Priority Data

Jul. 31, 2007 (SG) ..... 200705546-0

(51) Int. Cl.
*H01R 13/627* (2006.01)

(52) U.S. Cl. ..... 439/352

(58) Field of Classification Search ..... 439/352, 439/353, 357, 358, 489
See application file for complete search history.

(56) References Cited

U.S. PATENT DOCUMENTS 4,867,699 A * 9/1989 Oda et al. ..... 439/355
5,720,623 A 2/1998 Polenick et al.
6,068,507 A * 5/2000 Popa ..... 439/489
6,435,895 B1 * 8/2002 Fink et al. ..... 439/352
6,780,045 B2 * 8/2004 Shuey et al. ..... 439/489
7,470,138 B1 * 12/2008 Chen et al. ..... 439/352
2008/0124966 A1 * 5/2008 Lim ..... 439/357

FOREIGN PATENT DOCUMENTS

EP 0840398 A1 6/1998

* cited by examiner

*Primary Examiner*—Michael C Zarroli
*Assistant Examiner*—Harshad C Patel
(74) *Attorney, Agent, or Firm*—Rader, Fishman & Grauer, PLLC

(57) ABSTRACT

The second connector 2 has an inner housing 4 and an outer housing 5 that covers the outer peripheries of the inner housing 4, forming a gap $S_1$ for insertion of the first connector 14 therebetween. A receiving cavity $S_2$ is provided for insertion of the mating sensing member 8, and inside which is provided a pair of first stopper projections $\mathbf{5}_1$, a second stopper projections $\mathbf{5}_2$ and an elastically deformable locking arm 7, front end of which is a free extremity. The locking arm 7 is provides at the front end portion $\mathbf{7}_C$ with a pushing portion $\mathbf{7}_2$ and a first stopper $\mathbf{7}_4$ on each of the two sides. The mating sensing member 8 has a pair of elastically deformable first and second fingers $\mathbf{8}_A$, $\mathbf{8}_B$ positioned opposing each other in parallel and they have an actuation portion $\mathbf{8}_0$ and a stopper engaging portion $\mathbf{8}_D$.

5 Claims, 10 Drawing Sheets

(prior art)

ELECTRIC CONNECTOR

TECHNICAL FIELD

The present invention relates to an electric connector composed of a male connector and a female connector, and more particularly to an electric connector that has means for sensing the mating status of the two connectors.

BACKGROUND ART

Electric connectors composed of a male and a female connector usually have a locking means that prevents the two connectors from coming apart accidentally in the joined state. However, it sometimes happens that while the two connectors are being mated together and are in, say, a semi-mated state, their contact terminals become electrically connected to each other, in which case the two connectors will be joined without being locked, and therefore may come apart accidentally during use. Accordingly, electric connectors are known which have a mating sensing means that is able to sense the mating status in order to prevent such joining in a semi-mated state.

For instance, an electric connector 25 disclosed in U.S. Pat. No. 5,720,623 has a pair of first and second connectors 26 and 27 that are connected by being mated with each other as shown in FIG. 10. The second connector 27 has a structure such that a cavity 30 of a particular size is formed between a connector body 28 and cover 29 thereof, the cavity 30 runs through the interior in the lengthwise direction, and a locking arm 31 and a connector position assurance ("CPA" below) 32 are installed inside the cavity 30.

The locking arm 31 consists of a rectangular resilient arm having a particular width and length. The rear end of such resilient arm is fixed to the rear of the housing, and the front end extends as far as the insertion opening. A particular gap is provided between the connector body 28 and the cover 29, and the arm is elastically deformed in the vertical direction inside such gap. In this resilient locking arm 31 there is formed a slot 31*a*, having a particular width and length, in the lengthwise direction. The tip projection 33 of the CPA 32 is inserted into this slot 31*a*. Also, first and second latching holes $\mathbf{29}_1$ and $\mathbf{29}_2$ are formed in the two lengthwise sidewalls of the cover 29.

Further, the CPA 32 is so configured as to have a pair of side arms 35, 35 having a tip projection 33 as well as locking lugs 34, 34, and an L-shaped manipulation tab 36 that is connected to the side arms, each side arm being connected to an end portion of the manipulation tab 36's L-shape. The CPA 32's pair of locking lugs 34, 34 engage into the first and second latching holes $\mathbf{29}_1$, $\mathbf{29}_2$ of the cover 29.

For sensing of the mating status using the CPA 32, the CPA 32 is installed in advance into the cavity 30 of the second connector 27. When the CPA 32 is installed inside the cavity 30, the tip projection 33 of the CPA 32 strikes into and is latched by the end portion of the slot 31*a* in the locking arm, while the locking lugs 34 engage into the first latching hole $\mathbf{29}_1$. When, with the second connector 27 in such state, the first connector 26 is inserted thereinto, the first connector's latching projection 26*a* initially contacts against the bottom of the front end of the locking arm 31, then, as the first connector is inserted further, reaches the slot 31*a* in the locking arm 31 and enters into such slot, thereby raising up the tip projection 33 of the CPA 32, so that the tip projection 33 becomes unlatched from the end portion of the slot 31*a* in the locking arm 31. When the tip projection 33 becomes unlatched, pushing-in of the CPA 32 is enabled, and the CPA is pushed in. As a result of such pushing-in, the locking lugs 34 of the CPA 32 engage into the cover's second latching holes $\mathbf{29}_2$, and it can be sensed thereby that the first and second connectors have been joined in the normal state. Furthermore, EU Patent Application EP0840398A1 discloses an electric connector wherein the joining status of a pair of connectors can be sensed by a CPA that is slidably installed onto a latching member that is provided with a stop wing possessing resilience and is integrated onto the top surface of the connector housing.

In the electric connectors disclosed in both U.S. Pat. No. 5,720,623 and EU Patent Application EP0840398A1, the CPA is installed in advance to the housing of either the first or second connector, and during mating of the two connectors is tentatively pushed in. The connectors are sensed as being in the normal mated state if the CPA, when so pushed in, is inserted as far as a prescribed position, but if it is arrested part-way, they are sensed as not being in the normal mated positions and hence as being in an incompletely joined state. However, with these electric connectors, it is not possible to sense the mating status of the first and second connectors during the mating process thereof, which means that if it is determined via pushing-in of the CPA that the two connectors are in a semi-mated state, then it will be necessary to perform over again both the mating manipulation of the connectors and the installation of the CPA. Such manipulations may cause apprehensive feelings in the worker.

Depending on the electric connector's mode of utilization, it may in some cases be possible to establish the mating status more accurately by employing coordination between the degree of mating of the first and second connectors and the degree of pushing-in of the CPA when mating the two connectors together. For instance, dividing the mating manipulation of the first and second connectors and the manipulation of the CPA into several steps and joining the connectors via such steps may relieve the worker of apprehensive feelings.

Also, in the electric connectors disclosed in both U.S. Pat. No. 5,720,623 and EU Patent Application EP0840398A1, the connector housing in which the CPA is installed will be rendered higher, since the CPA will be elastically deformed in directions orthogonal to the lengthwise direction. Further, with the electric connector disclosed in EU Patent Application EP0840398A1, the CPA is exposed when installed to the connector housing, which means that objects could strike against and break or otherwise damage the CPA.

SUMMARY

An advantage of some aspects of the present invention is to provide an electric connector that has a mating sensing member able to sense the mating status of a pair of connectors during mating thereof.

Another advantage of some aspects of the present invention is to provide an electric connector wherein the mating sensing member is formed as a single part, thereby reducing the cost, and moreover can be installed to the housing with ease.

Further another advantage of some aspects of the present invention is to provide an electric connector that is rendered compact.

According to an aspect of the invention, an electric connector includes: a first connector in which first contact terminals are installed, a second connector in which second contact terminals are installed that are electrically connected to the first contact terminals, and a mating sensing member that senses the mating status of the first and second connectors when mated together. The first connector has a first latching protrusion on the outer surface of a housing in which the first contact terminals are installed. The second connector has an inner housing in which the second contact terminals are installed and an outer housing that covers the outer peripheries of the inner housing except a portion defining an insertion opening for the first connector A gap for insertion of the first connector is left between the inner housing and outer housing, and a receiving cavity is provided that is for insertion of the mating sensing member and that communicates with such gap. Inside the receiving cavity there are provided a pair of first stopper projections, a second stopper projection, and an elastically deformable locking arm that has one end fixed to the inner housing and the other, front end as a free extremity. In the locking arm there is provided an engagement slot with which the first connector's first latching protrusion engages, and moreover the front end is equipped with a pushing portion and a first stopper on each of the two sides thereof. The mating sensing member has a pair of elastically deformable first and second fingers positioned opposing each other in parallel. The first and second fingers are each provided, on the opposed faces thereof, with an actuation portion against which the locking arm's pushing portion pushes, and with a stopper engaging portion into which the first stopper engages. The first and second connectors are mated and connected by carrying out the following manipulations in the order given: a connector primary insertion manipulation consisting of installing the mating sensing member into the gap between the locking arm inside the second connector's receiving cavity and the outer housing, so as to be slidable therein, and inserting either the first or the second connector into/onto the other connector so that the locking arm is raised up by the first latching protrusion, a sensing member primary push-in manipulation consisting of pushing the mating sensing member into the receiving cavity, a connector secondary insertion manipulation consisting of further inserting the connector so that the locking arm ceases to be raised up, and a sensing member secondary push-in manipulation consisting of further pushing in the mating sensing member.

According to such aspect of the invention, the first and second connectors are joined together by carrying out in sequence: a connector primary insertion manipulation whereby one connector is inserted into/onto the other connector, followed by a sensing member primary push-in manipulation whereby the mating sensing member is pushed into the receiving cavity in the second connector, then a connector secondary insertion manipulation whereby the connector is further inserted, followed by a sensing member secondary push-in manipulation whereby the mating sensing member is further pushed in. More precisely, since the mating and joining together of the first and second connectors is carried out via a connector primary insertion manipulation, a sensing member primary push-in manipulation, a connector secondary insertion manipulation, and a sensing member secondary push-in manipulation, it is possible, during joining of the two connectors, to push in the mating sensing member in accordance with the degree of insertion of each connector, and through such linked manipulation of the connectors and the mating sensing member, to effect accurately the joining together of the first and second connectors. In other words, joining together the two connectors consists of a sequence of alternating connector insertion manipulations and mating sensing member push-in manipulations, and by means of such series of manipulations, the mating can be effected while verifying the linkage of the two connectors and the mating sensing member. As a result, the first and second connectors will be reliably joined.

According to another aspect of the invention, the first and second stopper projections may be formed as columnar projections of a particular height that are spaced a particular distance apart and project outward from the inner wall of the outer housing inside the receiving cavity, and a gap for preventing a front end portion of the locking arm from colliding with the columnar projections as the locking arm is raised up by the first connector's first latching protrusion may be provided between the columnar projections and the front end portion of the locking arm.

With the above aspect, because the first and second stoppers are formed with a certain spacing as columnar projections of a particular height that project outward from the inner wall of the outer housing inside the receiving cavity, the projections are simple to form. Also, thanks to the provision of a gap between the columnar projections and the front end portion of the locking arm in order that the front end portion of the locking arm will not collide with such columnar projections when the locking arm is raised up by the first connector's first latching protrusion, the elevation of the receiving cavity can be rendered low, and the second connector can be rendered compact.

According to a further aspect, one pair of ends of the mating sensing member's first and second fingers may be connected by a connecting part, the other ends be formed in a U-shape as free extremities, and the connecting part serve as a push-in manipulation part.

With such aspect, the second connector housing can be rendered compact because forming the mating sensing member in a U-shape permits housing thereof in the lowered-elevation receiving cavity. Also, having the connecting part serve as a push-in manipulation part facilitates the insertion into the receiving cavity.

According to a still further aspect, the stopper engaging portions of the first and second fingers may be formed as concavities of a size that enables the second connector's stopper projections to enter therein, and the first stopper strikes against the interior sidewalls of the concavities.

With such aspect, the fact that the first and second fingers' stopper engaging portions are formed as concavities of a size such that the second connector's stoppers will enter therein means that the stopper engaging portions are simple to form.

According to a yet further aspect, the locking arm's pushing portions and the mating sensing member's actuation portions may each be formed with inclined faces of particular angles.

With such aspect, thanks to the locking arm's pushing portions and the mating sensing member's actuation portions each being formed with inclined faces of a particular angle, the mating sensing member can be smoothly pushed outward by utilizing such inclined faces.

BRIEF DESCRIPTION OF THE DRAWINGS

The invention will be described with reference to the accompanying drawings, wherein like numbers reference like elements.

DESCRIPTION OF EXEMPLARY EMBODIMENT

Figure 1:
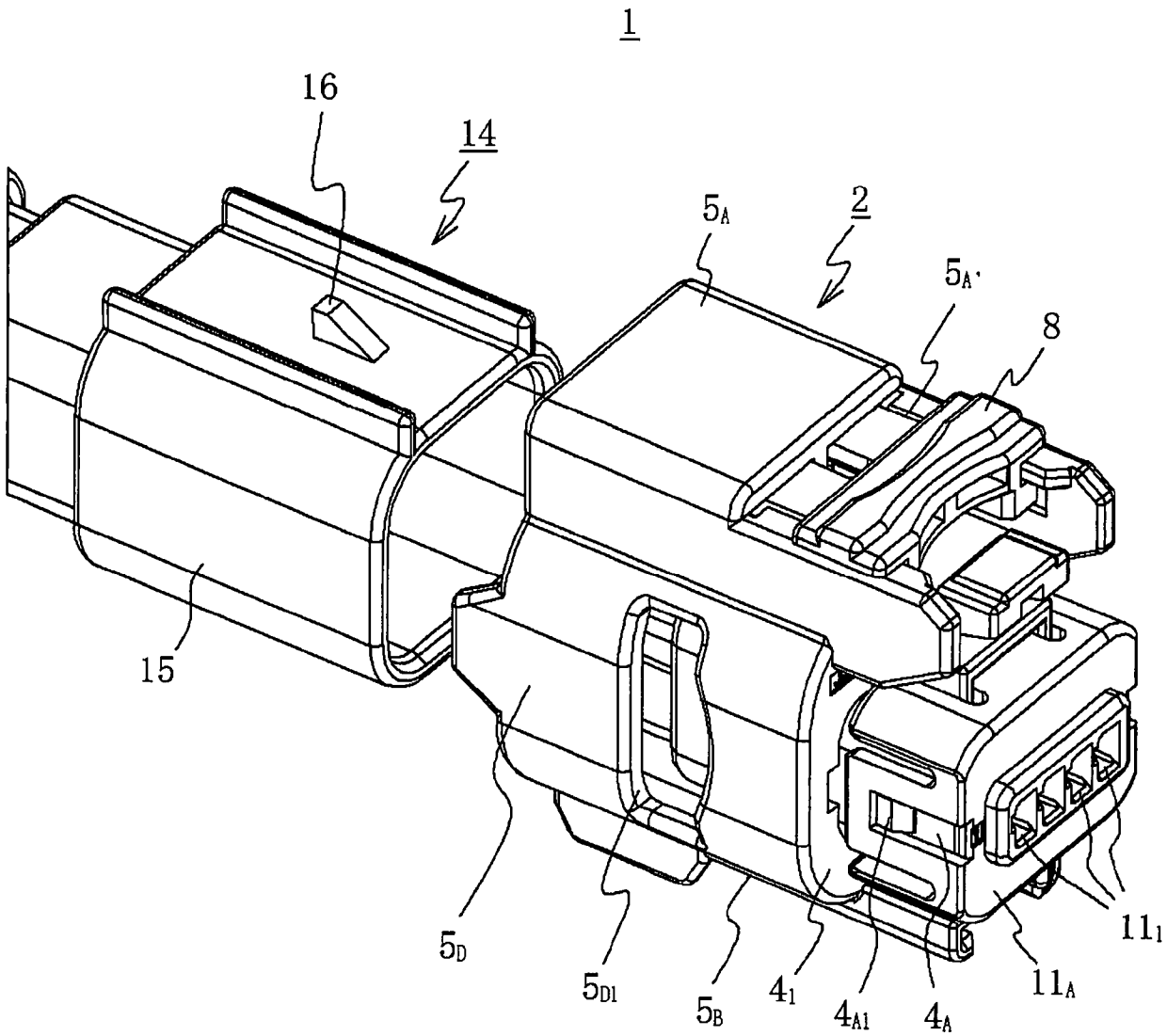
FIG. 1 is a perspective view of an electric connector of an embodiment of the present invention.
Figure 2A:
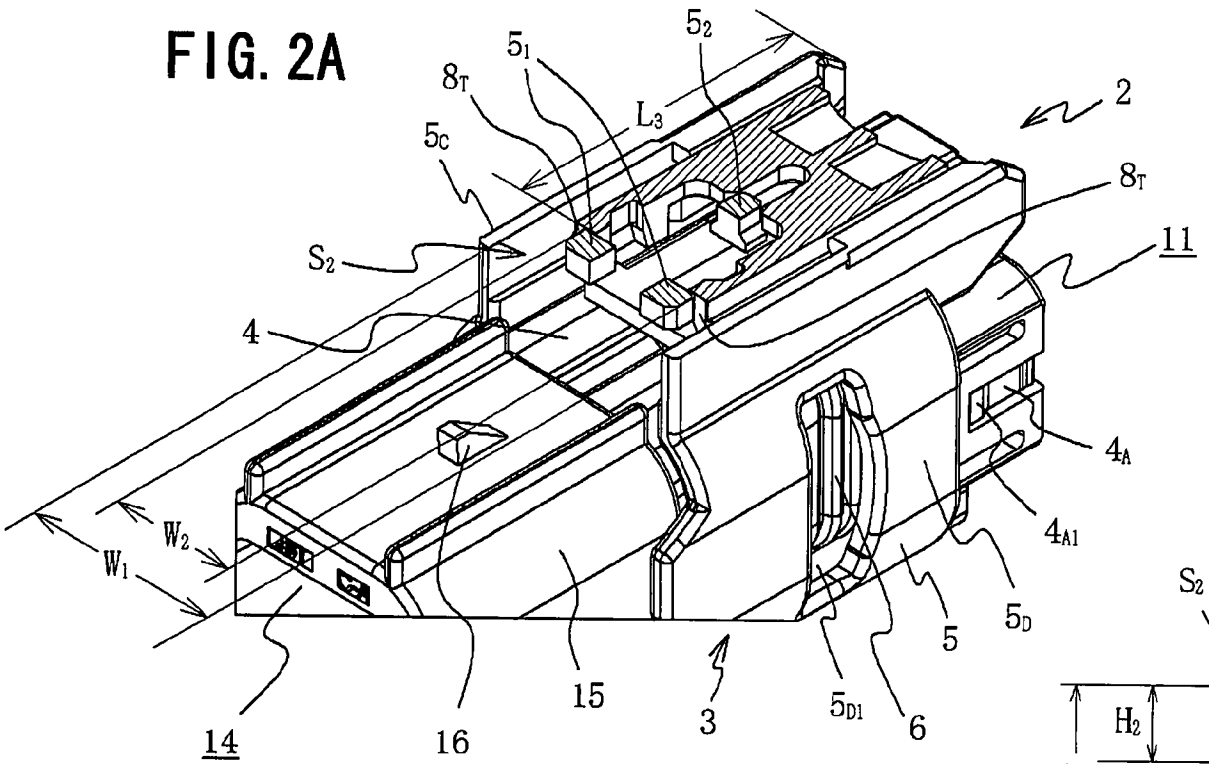
FIG. 2A is a perspective view of the electric connector in FIG. 1 with part of the female connector housing's outer wall cut away.
Figure 2B:
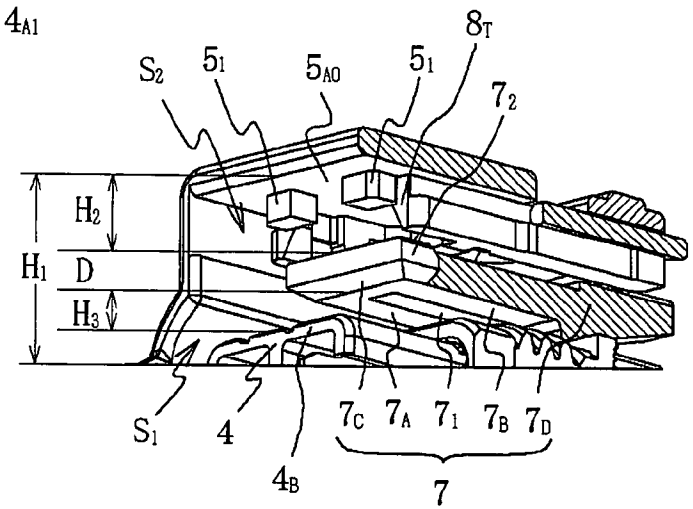
FIG. 2B is a perspective view of the interior of the housing at the cut-away portion in FIG. 2A.

An exemplary embodiment of the present invention will now be described with reference to the accompanying drawings. It will be understood however, that the following embodiment is intended merely by way of an illustrative example of an electric connector that realizes the technical concepts of the invention, not by way of limiting the invention to this particular electric connector. The invention can equally well be adapted to yield other embodiments within the scope and spirit of the claims. FIG. 1 is a perspective view of an electric connector of an embodiment of the invention, FIG. 2A is a perspective view of the female connector housing in FIG. 1 with part of the outer wall thereof cut away, FIG. 2B is a perspective view of the interior of the housing cut-away portion in FIG. 2A, and FIG. 3 is an exploded perspective view of the female connector in FIG. 1.

Figure 3:
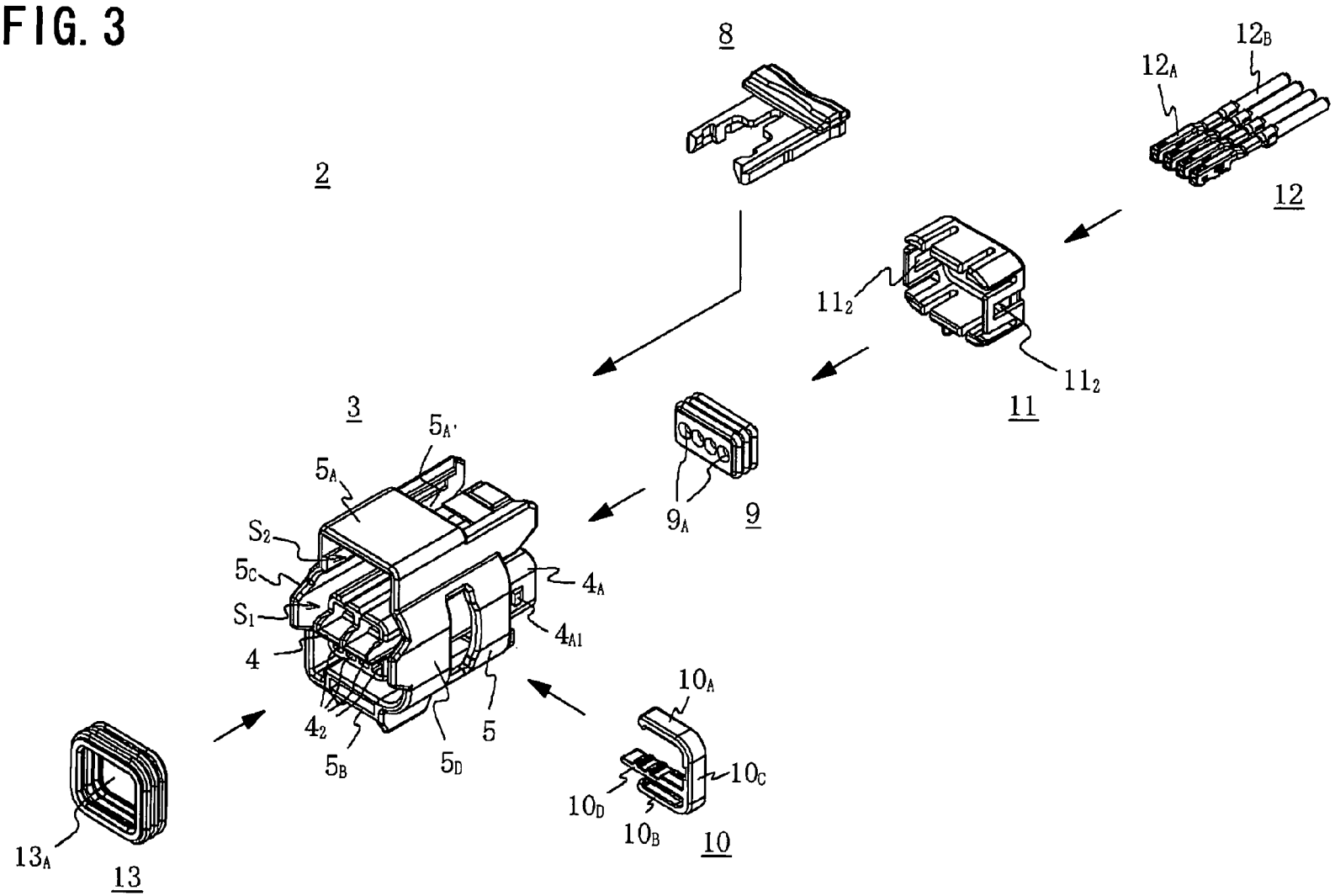
FIG. 3 is an exploded perspective view of the female connector.

As FIGS. 1 and 3 show, an electric connector 1 includes a female connector 2 (second connector) having a female connector housing ("female housing" below) 3 that houses multiple female contact terminals 12, and a male connector 14 (first connector) having a male connector housing ("male housing" below) 15 that houses male contact terminals 19 (first contact terminals) that are connected to the female contact terminals 12 (second contact terminals). The female connector 2 is so configured that a mating sensing member ("CPA" below) 8 that senses the status of mating with the male connector 14 is housed inside the female housing 3. Below, the female connector 2, CPA 8 and male connector 14 composing this electric connector 1 will each be described in turn with reference to the accompanying drawings.

Figure 4:
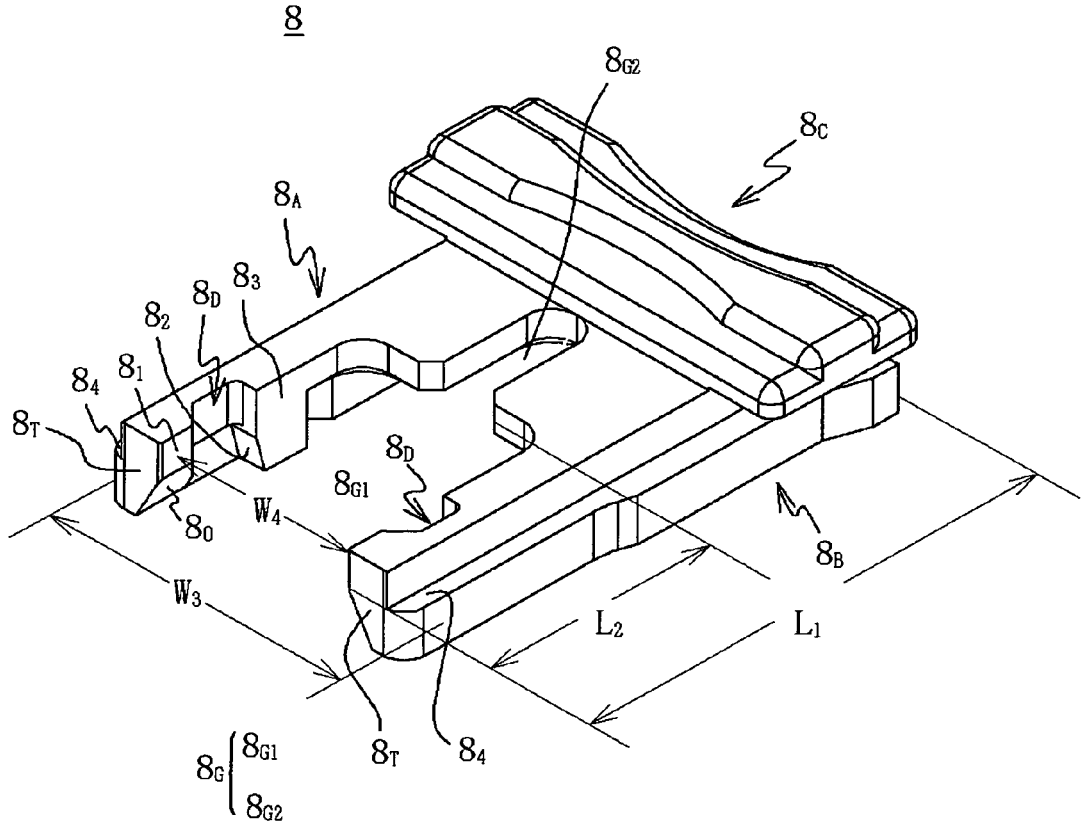
FIG. 4 is an enlarged perspective view of the CPA in FIG. 3.

First, the structure of the female connector will be described with reference to FIGS. 2 to 4. As FIG. 3 shows, the female connector 2 has: multiple female contact terminals 12, a female housing 3 that houses the female contact terminals 12, a CPA 8 that is installed inside the female housing 3, a terminal sensing member 10 ("TPA" below) that senses whether or not the female contact terminals. 12 have been correctly installed inside the female housing 3, a cover member 11 that is installed to the rear end of the female housing 3, a seal member 9 through which the female contact terminals 12 are inserted and which seals the outer peripheries thereof so as to prevent penetration of water, etc., thereinto, and a seal member 13 that prevents entry of water, etc., when the female connector 2 is joined to the male connector 14.

As FIG. 2 shows, the female housing 3 has an inner housing 4 in which the female contact terminals 12 are installed, and an outer housing 5 that covers the outside surfaces of the inner housing 4 except at the front and rear. The inner housing 4 and outer housing 5 have a particular gap therebetween and are joined at the rear portions thereof. The female housing 3 is formed as a molding of electrically insulative synthetic resin material.

The inner housing 4 is of a rectangular shape having a particular width, height and depth, and at the rear thereof there is formed a projecting portion $\mathbf{4}_A$ onto which the cover member 11 is installed. Multiple installation holes $\mathbf{4}_2$ into which the multiple female contact terminals 12 are installed are formed as through-holes in the inner housing 4, extending longitudinally from the front to the projecting portion $\mathbf{4}_A$ at the rear.

The multiple female contact terminals 12 are inserted through the installation holes $\mathbf{4}_2$ at the projecting portion $\mathbf{4}_A$ end. Latching protrusions $\mathbf{4}_{A1}$ onto which the cover 11 latches are formed on the sidewalls of the projecting portion $\mathbf{4}_A$. Installation holes 6 for insertion of the TPA 10 are formed in the sidewalls of the inner housing 4 (see FIG. 2).

As FIGS. 2 and 3 show, the outer housing 5 covers, with its periphery walls $\mathbf{5}_A$ to $\mathbf{5}_D$, the outer surfaces of the inner housing 4. The front of the outer housing 5 is formed as an insertion opening for insertion of the male connector 14's male housing 15, and the rear is joined to the rear wall $\mathbf{4}_1$ of the inner housing 4. The periphery walls $\mathbf{5}_A$ to $\mathbf{5}_D$ consist of a top wall $\mathbf{5}_A$, a bottom wall $\mathbf{5}_B$, and two sidewalls $\mathbf{5}_C$ and $\mathbf{5}_D$. Between the inner and outer housings 4, 5 there are formed an insertion gap $S_1$ for insertion of the male housing 15 and a receiving cavity $S_2$ for insertion of the CPA 8. Part of the rear portion $\mathbf{5}_{A'}$ of the outer housing 5's top wall $\mathbf{5}_A$ is cut away to allow insertion of the gripper portion of the CPA 8, and the interior of the receiving cavity $S_2$ is thereby exposed (see FIG. 1).

The receiving cavity $S_2$ between the top wall of the inner housing 4 and the top wall $\mathbf{5}_A$ of the outer housing 5 is of a size permitting installation of the CPA 8 and also of the locking arm 7 described hereafter. The receiving cavity $S_2$ has a particular height $H_1$ and width $W_1$. The height $H_1$ is made up of the gap $H_3$ between the locking arm 7's bottom surface and the inner housing 4's top wall $\mathbf{4}_B$, and the gap $H_2$ between the locking arm 7's top surface and the inner surface of the outer housing 5's top wall $\mathbf{5}_A$, plus the plate thickness D. Also, the width $W_1$ of the receiving cavity $S_2$ is formed to be slightly larger than the width of the CPA8, so as to permit insertion of the CPA 8. The inner surface of the top wall $\mathbf{5}_A$ is inside the receiving cavity $S_2$ and constitutes a ceiling surface $\mathbf{5}_{A0}$ thereof that is located superiorly relative to the top wall $\mathbf{4}_B$ of the inner housing 4.

The locking arm 7 is formed as a resilient plate-form body of tongue-like shape having a particular thickness D, width and length. As FIG. 2B shows, the locking arm 7's base portion $\mathbf{7}_D$ is formed at the rear wall of the inner housing 4, and the locking arm 7 extends forward from the base portion $\mathbf{7}_D$. The thickness D allows for elastic deformation and is determined so that in the horizontally extended state the arm will not contact with the first ceiling protrusions $\mathbf{5}_1$, $\mathbf{5}_1$ (first stopper projections). The width is smaller than the width $W_1$ of the receiving cavity $S_2$.

Figure 7A:
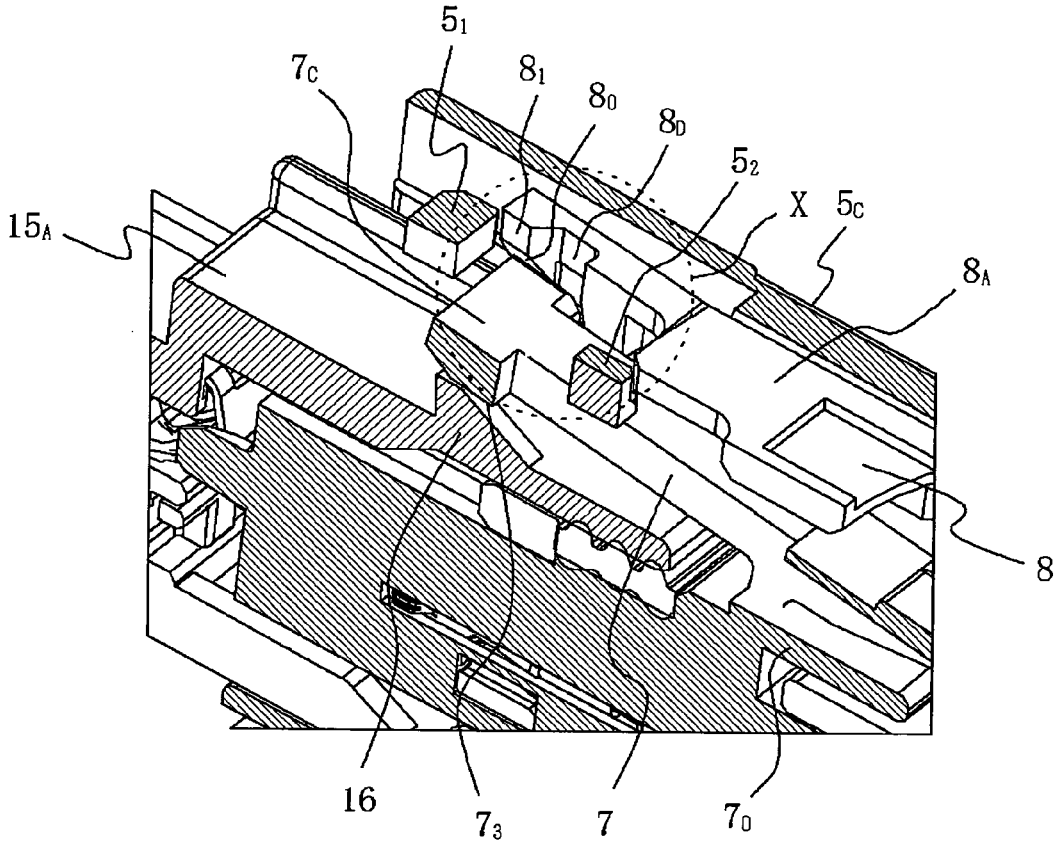
FIG. 7A is a cross-sectional view illustrating the state where the male connector has been inserted further relative to the state in FIG. 6.
Figure 7B:
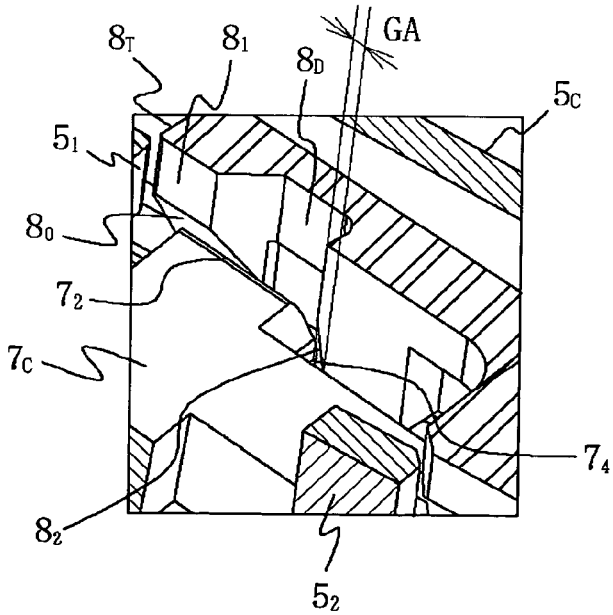
FIG. 7B is an enlarged view of portion X in FIG. 7A.

At roughly the central portion of the locking arm 7 there is formed an engagement slot $\mathbf{7}_1$ into which the latching protrusion 16 of the male housing 15 latches. The engagement slot $\mathbf{7}_1$ is surrounded by the two side edges $\mathbf{7}_A$, $\mathbf{7}_B$ and the front end portion $\mathbf{7}_C$. On the two sidewalls of the front end portion $\mathbf{7}_C$ there are formed inclined faces $\mathbf{7}_2$ that perform the function of contacting with the inclined faces of the fingers of the CPA 8 to be described hereafter, and pushing the fingers outward (see FIG. 2B). FIG. 2B shows only the inclined face $\mathbf{7}_2$ on one sidewall, but such an inclined face is also formed on the other side of the front end portion. These inclined faces $7_2$ serve as pushing portions that push outward the first and second fingers $8_A$, $8_B$ of the CPA 8 described hereafter. Also, jutting parts $7_4$ are formed on the rear surfaces of the front end portion $7_C$ (see FIG. 7B). These jutting parts $7_4$ serve as what may be called stoppers that temporarily arrest the pushing-in of the CPA 8.

The locking arm 7 has its base portion $7_D$ formed in the rear wall of the inner housing 4, the front end portion $7_C$ being a free extremity, and is elastically deformable in the vertical direction relative to the base portion $7_D$ as reference point. Thanks to such structure, when the male housing 15 is inserted during joining with the male connector 14, the latching protrusion 16 thereof will contact against the front end portion $7_C$, and as a result of such contacting, the locking arm 7 will be pushed upward relative to the base portion $7_D$ as reference point. The front end portion $7_C$'s inclined faces $7_2$, $7_2$, projected by such upward pushing, will contact against the inclined faces $8_0$, $8_0$ of the CPA 8, pushing wider the gap between the first and second fingers $8_A$, $8_B$ of the CPA 8. When the male housing 15 is pushed in further, the latching protrusion 16 will slide over and past the lower surface $7_3$ of the front end portion $7_C$ and enter the engagement slot $7_1$. When the latching protrusion 16 enters the engagement slot $7_1$, the locking arm 7 will descend by its own resilience and engage with the latching protrusion 16, thus latching the male housing 15 to the female housing 3.

Inside the receiving cavity $S_2$, as FIG. 2B shows, three ceiling projections $5_1$, $5_1$, $5_2$ are formed on the ceiling surface $5_{A0}$, projecting downward therefrom. The pair of first ceiling projections $5_1$, $5_1$ are columnar, are located in the forward part of the receiving cavity $S_2$, and perform the function of regulating the pushing-in of the CPA 8 to be described hereafter. The second ceiling projection $5_2$ (second stopper projection) is located in the rearward part of the receiving cavity $S_2$, that is, at the end where the female contact terminals 12 are connected, and faces a slot in the CPA 8. These first and second ceiling projections $5_1$, $5_2$ are provided in places where they will not impede the motion of the locking arm 7, and are of a height such as not to contact with the locking arm 7.

The structure of the CPA 8 will next be described with reference to FIG. 4. FIG. 4 is an enlarged perspective view of the CPA in FIG. 3.

The CPA 8 has a pair of elastically deformable first and second fingers $8_A$, $8_B$ that oppose each other in parallel, with a particular gap $8_G$ therebetween, and a connecting part $8_C$ that connects one pair of ends of such fingers. The other ends of the fingers $8_A$, $8_B$ are left free, and the whole makes a U-shape that is formed as a molding of electrically insulative synthetic resin. This CPA 8 has a longitudinal direction length $L_1$ and width $W_3$, and is formed as a plate-form body of a particular thickness. The connecting part $8_C$ serves as a gripper of a size that is readily grippable with one's fingertips. The provision of such gripper facilitates the pushing of the female housing 3 into the receiving cavity $S_2$. The gap $8_G$ includes a wide gap portion $8_{G1}$ at the opening entrance of the U-shape, and a narrow slot portion $8_{G2}$ in the inmost part thereof. The entrance gap portion $8_{G1}$ extends inward to a distance $L_2$ from the entrance. This distance $L_2$ is roughly half the distance $L_1$.

The spacing $W_4$ is a little smaller than the spacing $W_2$ between the pair of ceiling projections $5_1$, $5_1$ (see FIG. 2). More precisely, the design is such that although the spacing $W_4$ is formed to be smaller than the spacing $W_2$ between the pair of ceiling projections $5_1$, $5_1$ ($W_4<W_2$), when the fingers $8_A$, $8_B$ are stretched outward the spacing $W_4$ will become larger than the spacing $W_2$ ($W_4>W_2$). With the spacings $W_4$, $W_2$ determined in the foregoing manner, when the CPA 8 is inserted into the receiving cavity $S_2$, the CPA 8's top portions $8_T$, $8_T$ will strike the ceiling projections $5_1$, $5_1$, and thereby further insertion will be arrested. Subsequently, such arrested state will be terminated by the outward stretching of the fingers $8_A$, $8_B$. Also, provision of the gap $8_{G2}$ facilitates elastic deformation of the fingers $8_A$, $8_B$. Further, the ceiling projection $5_2$ enters into the gap $8_{G2}$, which performs the role of positioning, when the CPA 8 is inserted into the receiving cavity $S_2$.

The finger $8_A$ will now be described. Since the other finger $8_B$ of the pair has the same shape, description thereof is omitted.

The finger $8_A$ extends forward from the connecting part $8_C$, and from part-way along, the inner surface thereof is processed into particular shapes. More particularly, the finger $8_A$ has a tip portion $8_T$ with a particular shape, and a recess $8_D$ provided in the inner surface at a place a little inward from the tip portion. The tip portion $8_T$ has a flat inner face $8_1$, and an inclined face $8_0$ that is inclined downward at a sharp angle from the inner face. When the inclined face $7_2$ of the female housing 3's locking arm 7 contacts against it during joining with the male connector 14, this inclined face $8_0$ performs the role of making the finger $8_A$ elastically deform outward, and hence constitutes what may be termed an actuation portion. The recess $8_D$ is of a size that allows the ceiling projection $5_1$ to enter therein, and serves as what may be termed a stopper, since the ceiling projection $5_1$ fits thereinto and engages therewith. One sidewall of the recess $8_D$, specifically the sidewall $8_2$ on the side nearer to the connecting part $8_C$, serves as a stopper, in that when the locking arm 7's jutting part $7_4$ (see FIG. 6) strikes thereagainst, insertion of the CPA 8 is inhibited. The recess $8_D$ is a stopper engaging portion that by engaging with the ceiling projection and striking against the locking arm 7's jutting part $7_4$ performs the function of the stopper inhibiting temporary insertion.

The female contact terminals, TPA, cover member and seal members will now be described with reference to FIGS. 1 and 3.

The female contact terminals are composed of a female contact $12_A$ and a lead wire $12_B$ that is connected to the female contact $12_A$. The cover member 11 has a box-like shape of a size such as to fit over the projecting portion $4_A$ of the inner housing 4, and is formed as a molding of electrically insulative resin. In the base wall $11_A$ of the cover member 11 there are formed insertion holes $11_1$ that communicate with the installation holes $4_2$. Extending outward from the base wall $11_A$ there are formed multiple slots in the periphery walls, as well as engagement slots $11_2$ in the opposed sidewalls. Formation of multiple slots in the periphery walls facilitates elastic deformation and simplifies installation to the projecting portion. The seal member 9 has, in the middle thereof, insertion holes $9_A$ through which the female contact terminals are inserted, and is formed from a resilient material, say rubber material, of a particular thickness. The seal member 13 is press-fitted onto the periphery of the inner housing 4 so as to seal the space between such and the male connector 14, has in the middle a hollow space 13A through which the inner housing 4 is inserted, and is formed from a resilient material, say rubber material, of a particular thickness.

Assembly of the female connector 2 will next be described with reference to FIGS. 1 to 4.

First, the female contact terminals 12 are inserted through the insertion holes 9A in the cover member 11 and the seal member 9, the seal member 9 is brought into contact against the projecting portion $4_A$ of the inner housing 4, the cover member 11 is latched onto the projecting portion $4_A$, and the female contact terminals 12 are inserted into the interior of the female housing 3. Next, the TPA 10 is inserted through the cut-away portion $\mathbf{5}_{D1}$ in the outer housing 5, and the contact terminals 12 are positioned and fixed inside the female housing 3. After that, the first and second fingers $\mathbf{8}_A$, $\mathbf{8}_B$ of the CPA 8 are inserted through the rear of the female housing 3 into the receiving cavity $S_2$. As a result of such insertion, the tip portions $\mathbf{8}_T$, $\mathbf{8}_T$ of the CPA 8 strike against the ceiling projections $\mathbf{5}_1$, $\mathbf{5}_1$ and are blocked. Thereupon, assembly of the female connector 2 is complete.

Figure 5:
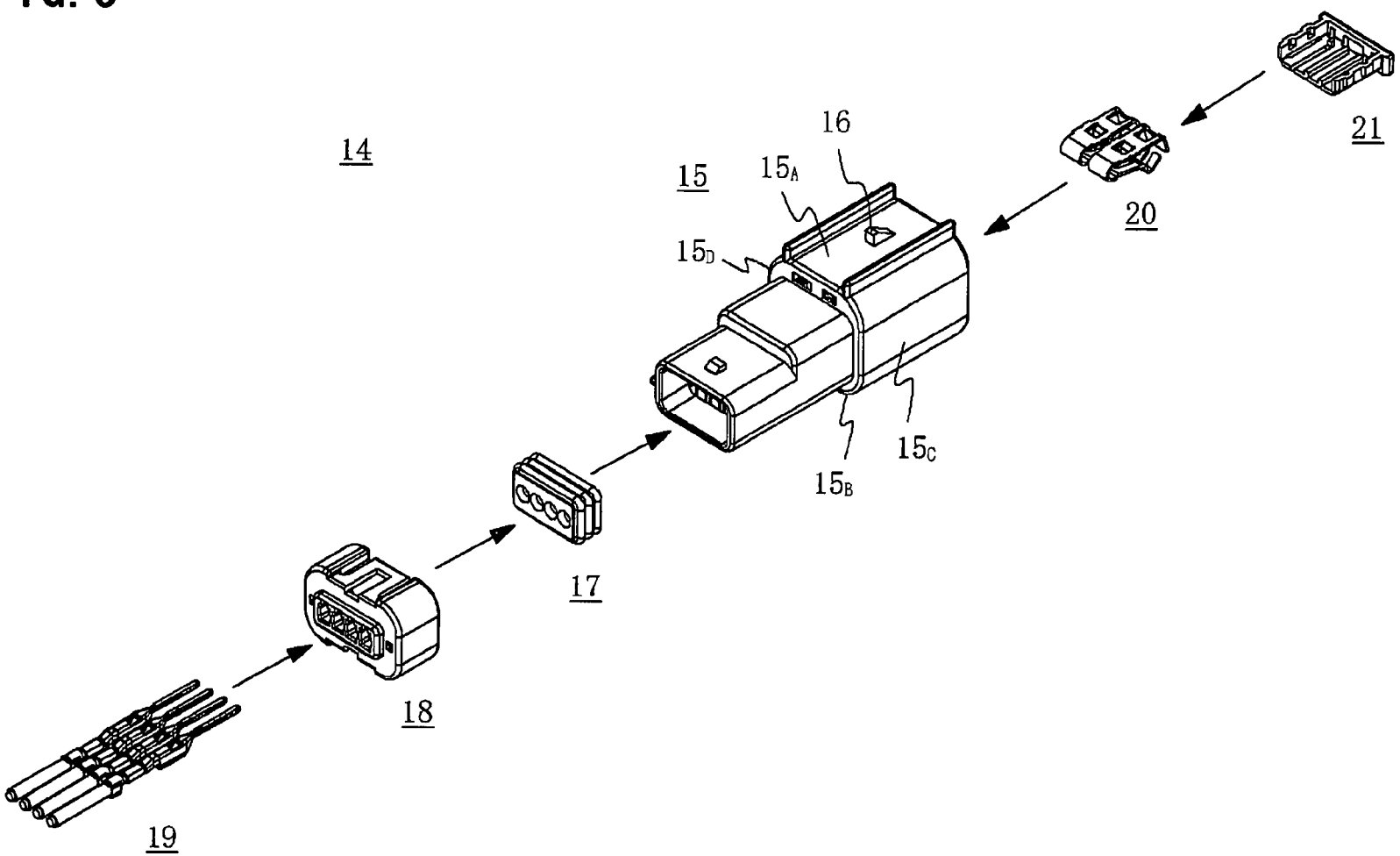
FIG. 5 is an exploded perspective view of the male connector.

The male connector will now be described with reference to FIG. 5. FIG. 5 is an exploded perspective view of the male connector.

As FIG. 5 shows, the male connector 14 has multiple male contact terminals 19, a male housing 15 that houses the male contact terminals 19, a terminal sensing member ("TPA" below) that senses whether or not the contact terminals 19 have been correctly installed inside the male housing 15, a cover member 18 that is installed to the rear end of the male housing 15, that is, the end where the male contact terminals 19 are installed, and a seal member 17 through which the male contact terminals 19 are inserted and which seals the outer peripheries thereof so as to prevent penetration of water, etc., thereinto.

The male housing 15 has periphery walls $\mathbf{15}_A$ to $\mathbf{15}_D$, is a cylindrical body of a size permitting insertion into the gap between inner housing 4 and outer housing 5 of the female housing 3, and is formed from electrically insulative synthetic resin. A single latching protrusion 16 is formed on the top periphery wall $\mathbf{15}_A$ of the male housing 15.

To assemble the male connector 14, first the male contact terminals 19 are inserted through the insertion holes in the cover member 18 and the seal member 17, the seal member 9 is inserted into the interior of the male housing 15, the cover member 18 is latched, and the female contact terminals 12 are inserted into the interior of the male housing 15. Then a shorting terminal 20 is fitted, together with a mounting member 21, through the front of the male housing 15, whereupon assembly of the male connector 14 is complete.

Next will be described, with reference mainly to FIGS. 6 to 9, the connection of the female and male connectors and the action of the CPA 8. FIGS. 6 to 9 are explanatory views illustrating the process of connecting the female and male connectors, FIG. 6 being a cross-sectional view illustrating the initial joined state where the male connector has been inserted into the female connector, FIG. 7A a cross-sectional view illustrating the joined state where the male connector has been further inserted relative to the state in FIG. 6, FIG. 7B an enlarged view of portion X in FIG. 7A, FIG. 8 a cross-sectional view illustrating the joined state where the CPA has been further inserted relative to the state in FIG. 7, FIG. 9A a cross-sectional view illustrating the joined state where the male connector has been further inserted relative to the state in FIG. 8, and FIG. 9B a cross-sectional view illustrating the final joined state.

Figure 6:
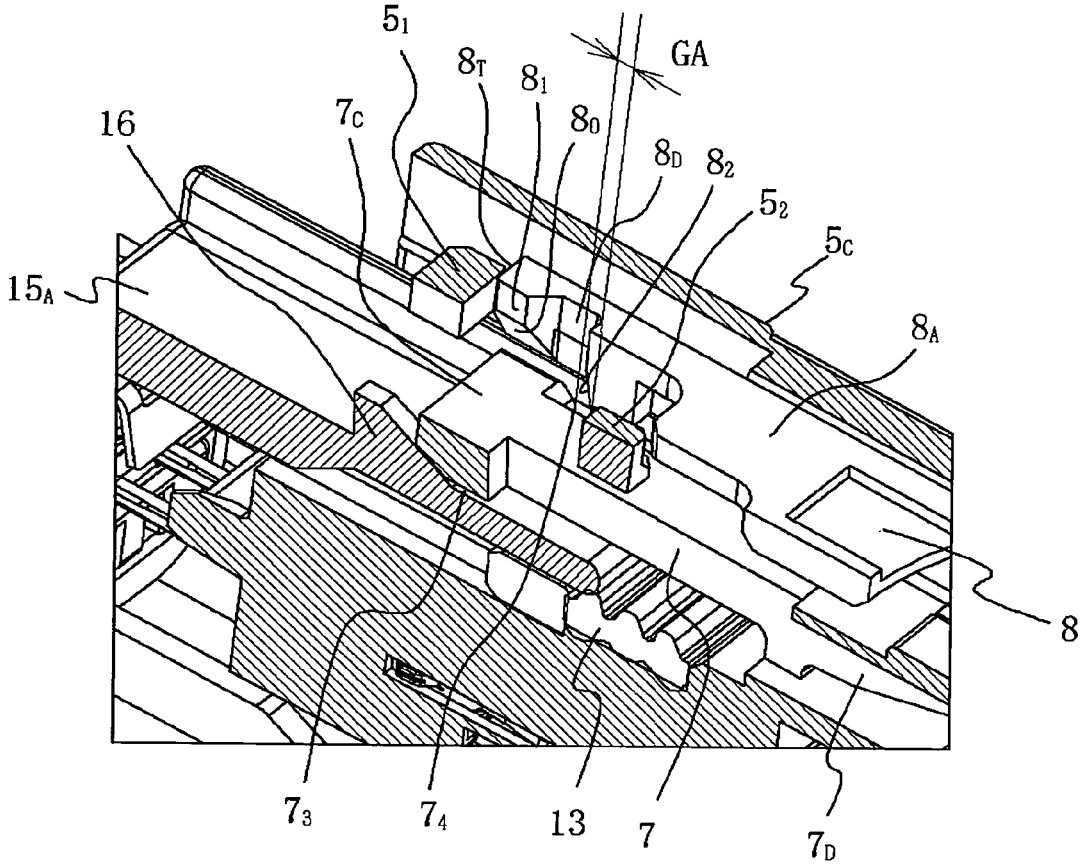
FIG. 6 is a cross-sectional view illustrating the initial joined state where the male connector has been inserted into the female connector.

The CPA 8 is installed in advance into the receiving cavity $S_2$ in the female housing 3 of the female connector 2, as shown in FIGS. 1 and 2. Such installation of the CPA 8 is carried out via insertion into the receiving cavity $S_2$. When the CPA 8 is inserted into the receiving cavity S2 in the female housing 3, the tip portions $\mathbf{8}_T$, $\mathbf{8}_T$ of the CPA 8 strike against the ceiling projections $\mathbf{5}_1$, $\mathbf{5}_1$ inside the receiving cavity $S_2$ as shown in FIGS. 2 and 6, and such is the state in which the CPA 8 is installed inside the receiving cavity $S_2$. The male housing 15 of the male connector 14 is then inserted into the female housing 3 with the CPA 8 installed therein. In such initial insertion, the latching protrusion 16 of the male housing 15 contacts against the lower surface $\mathbf{7}_3$ of the front end portion $\mathbf{7}_C$ of the locking arm 7 provided in the female housing 3, as shown in FIG. 6. Also, at this stage there is a gap GA between the sidewall $\mathbf{8}_2$ of the CPA 8's recess $\mathbf{8}_D$ and the jutting part $\mathbf{7}_4$ of the locking arm 7 inside the receiving cavity $S_2$. In fact, a recess $\mathbf{8}_D$ and a jutting part $\mathbf{7}_4$ are formed in both the CPA 8 and the locking arm 7, thus constituting pairs of these respective items, but since FIGS. 6 to 9 are cross-sectional views cut along a longitudinal section of the connector, only one member of each such pair, pairs of recesses $\mathbf{8}_D$ and of jutting parts $\mathbf{7}_4$, etc., is shown in these drawings, and accordingly only one of each is described below.

First is performed the connector primary insertion manipulation of pushing the male housing 15 into the female housing 3. As a result of such insertion manipulation, the latching protrusion 16 of the male housing 15 pushes up the lower surface $\mathbf{7}_3$ of the front end portion $\mathbf{7}_C$ of the locking arm 7 provided in the female housing 3, as shown in FIG. 7. As a result of such pushing-up, the locking arm 7 is elastically deformed upward relative to the base portion $\mathbf{7}_D$ as reference point. As a result of such upward elastic deformation of the locking arm 7, the inclined faces $\mathbf{7}_2$ on the two sidewalls of the front end portion $\mathbf{7}_C$ contact against the inclined faces $\mathbf{8}_0$ of the CPA 8, pushing outward the fingers $\mathbf{8}_A$ of the CPA 8. Hitherto the tip portions $\mathbf{8}_T$ of the fingers $\mathbf{8}_A$ have been contacting against the ceiling projections $\mathbf{5}_1$ so that push-in motion of the CPA 8 was arrested, but with the pushing outward of the fingers $\mathbf{8}_A$, the tip portions $\mathbf{8}_T$ are released from being latched by the ceiling projections $\mathbf{5}_1$ and pushing-in of the CPA 8 is enabled. Accordingly, the CPA primary push-in manipulation of pushing the CPA 8 into the receiving cavity $S_2$, is then performed.

Figure 8:
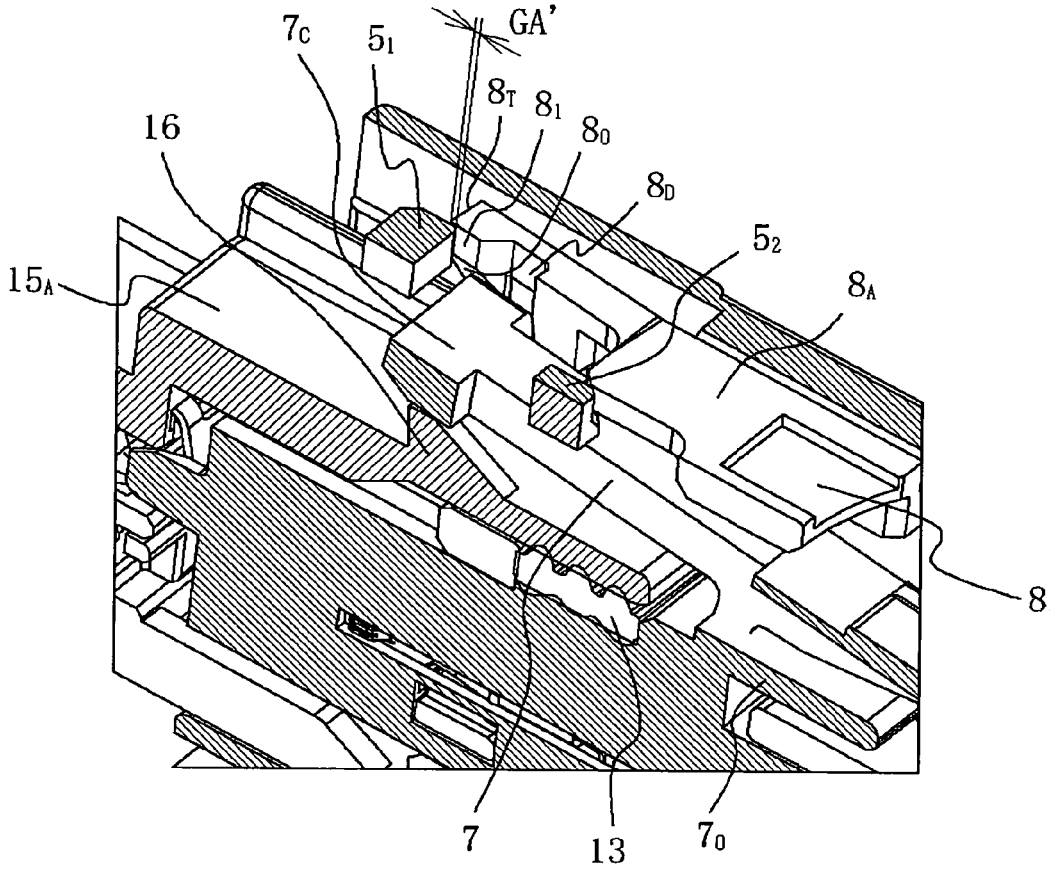
FIG. 8 is a cross-sectional view illustrating the state where the CPA has been pushed in further relative to the state in FIG. 7.

As a result of such push-in manipulation, the sidewall $\mathbf{8}_2$ of the recess $\mathbf{8}_D$ contacts against the jutting part $\mathbf{7}_4$ of the locking arm 7, temporarily arresting the pushing-in, as shown in FIG. 8. The amount by which the CPA 8 is pushed in is equal to the gap GA, and the tip portions $\mathbf{8}_T$ of the CPA 8 are brought into contact with the ceiling projections $\mathbf{5}_1$ so as to close the gap GA' therebetween, which is the same size as the gap GA. Following such CPA primary push-in manipulation, the connector secondary insertion manipulation of pushing in the male housing 15 is performed.

Figure 9A:
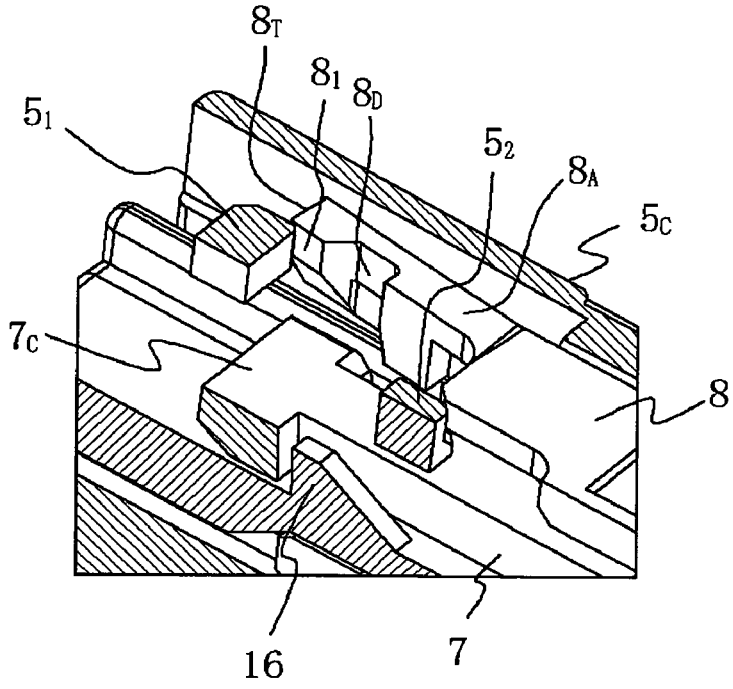
FIG. 9A is a cross-sectional view illustrating the state where the male connector has been inserted further relative to the state in FIG. 8.
Figure 9B:
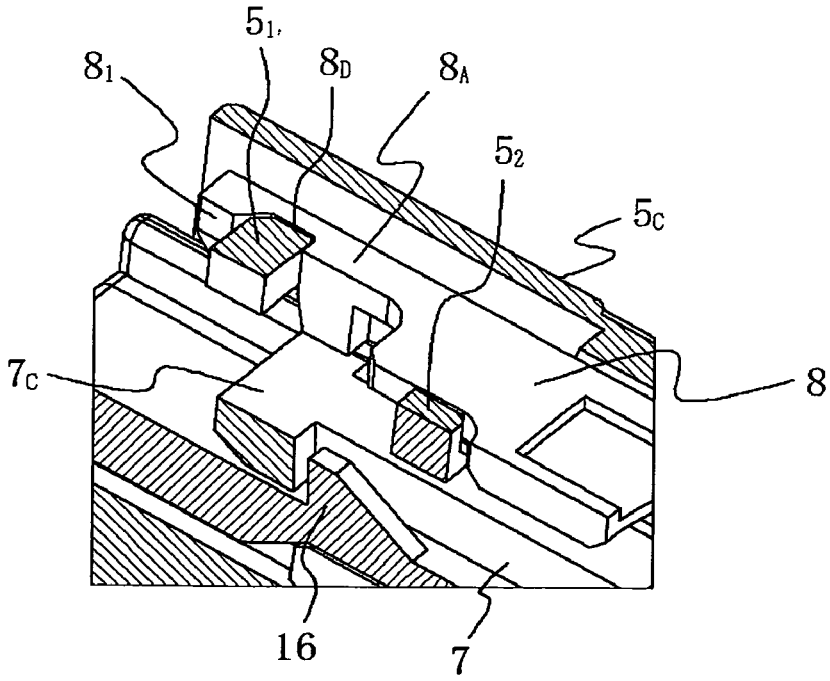
FIG. 9B is a cross-sectional view illustrating the final joined state where the CPA has been pushed in further relative to the state in FIG. 9A.
Figure 10:
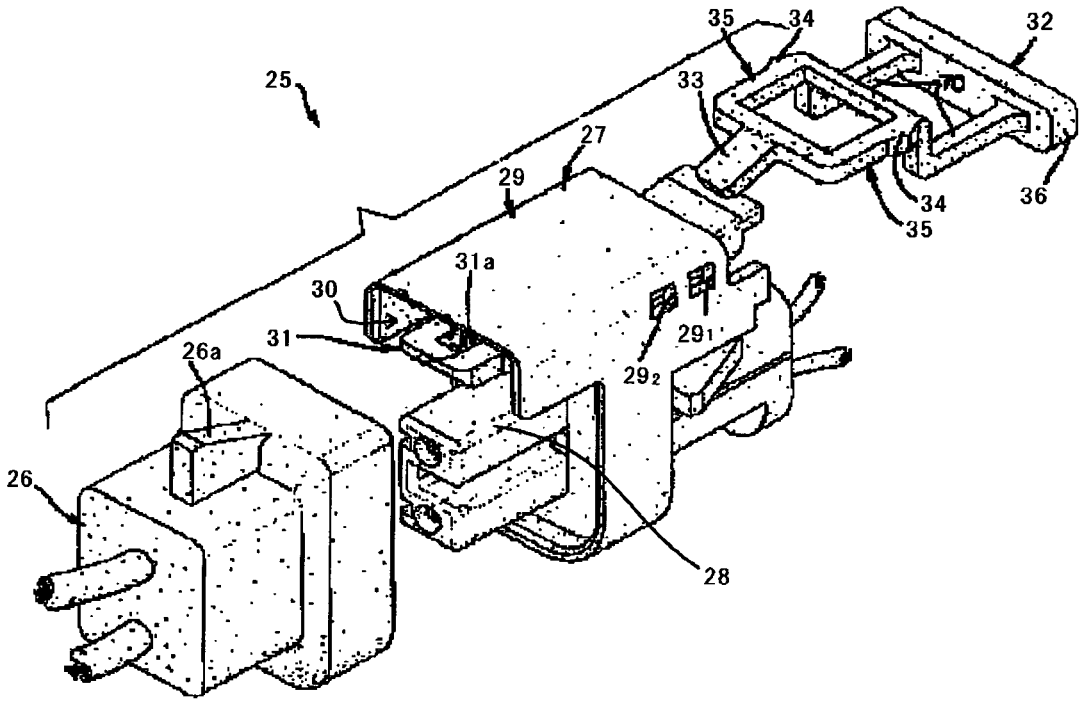
FIG. 10 is a general perspective view of an electric connector of the related art.

As a result of such secondary insertion manipulation, the tip portion of the male housing 15's latching protrusion 16 slides over and past the lower surface $\mathbf{7}_3$ of the locking arm $\mathbf{7}_C$ and enters the engagement slot $\mathbf{7}_1$, as shown in FIG. 9A. When the latching protrusion 16 enters the engagement slot 16, the locking arm 7 descends by its own resilience and engages with the latching protrusion 16. At the same time, the sidewall $\mathbf{8}_2$ of the recess $\mathbf{8}_D$ is released from pressing against the jutting part $\mathbf{7}_4$ of the locking arm 7, thus enabling pushing-in of the CPA 8. Accordingly, the CPA secondary push-in manipulation of pushing the CPA 8 further into the interior of the receiving cavity $S_2$, is then performed.

As a result of such push-in manipulation, the ceiling projection $\mathbf{5}_1$ enters into the recess $\mathbf{8}_D$ in the CPA 8, and the CPA 8 is latched. Thereby, the male housing 15 is correctly joined to the interior of the female housing 3, so that connection of the male connector 14 with the female connector 2 is completed and locked. To uncouple the male connector 14, a tool is inserted inside the receiving cavity $S_2$ in the female housing 3, the locking of the CPA is released, and the male connector 14 is pulled out and removed.

Thus, as described above, the female connector 2 and the male connector 14 are mated and connected together by carrying out, in sequence, a connector primary insertion manipulation whereby one connector is inserted into the other and the locking arm is pushed up by the first latching protrusion, a sensing member primary push-in manipulation whereby the mating sensing member is pushed into the receiving cavity in the second connector, a connector secondary insertion manipulation whereby the connector in question is inserted further and the locking arm ceases to be pushed up, and a sensing member secondary push-in manipulation whereby the mating sensing member is pushed in further.

Hence, since the female connector 2 and the male connector 14 are fitted together via a connector primary insertion manipulation, a mating sensing member primary push-in manipulation, a connector secondary insertion manipulation, and a mating sensing member secondary push-in manipulation, the mating sensing member can be pushed in according to the degree of insertion of the two connectors, and thanks to such linked manipulations of the two connectors and the mating sensing member, the first and second connectors can be joined reliably. In other words, joining the female connector 2 and male connector 14 together involves a sequence of connector insertion manipulations alternating with mating sensing member push-in manipulations, and through such series of manipulations the mating can be effected while verifying the linkage of the two connectors and the mating sensing member, thanks to which the two connectors can be joined reliably without any apprehensive feelings being caused in the worker.

What is claimed is:

1. An electric connector comprising:

a first connector in which first contact terminals are installed, a second connector in which second contact terminals are installed that are electrically connected to the first contact terminals, and a mating sensing member that senses the mating status of the first and second connectors when mated together;

the first connector having:

a first latching protrusion on the outer surface of a housing in which the first contact terminals are installed;

the second connector having:

an inner housing in which the second contact terminals are installed; and an outer housing that covers the outer peripheries of the inner housing except a portion defining an insertion opening for the first connector;

a gap for insertion of the first connector being left between the inner housing and outer housing; a receiving cavity being provided that is for insertion of the mating sensing member and that communicates with such gap; inside the receiving cavity there being provided a pair of first stopper projections, a second stopper projection, and an elastically deformable locking arm that has one end fixed to the inner housing and the other, front end as a free extremity; in the locking arm there being provided an engagement slot with which the first connector's first latching protrusion engages, and at the front end, a pushing portion and a first stopper on each of the two sides;

the mating sensing member having:

a pair of elastically deformable first and second fingers positioned opposing each other in parallel; the first and second fingers being each provided, on the opposed faces thereof, with an actuation portion against which the locking arm's pushing portion pushes and with a stopper engaging portion into which the first stopper engages.

2. The electric connector according to claim 1, wherein the first and second stopper projections are formed as columnar projections of a particular height that are spaced a particular distance apart and project outward from the inner wall of the outer housing inside the receiving cavity, and a gap for preventing a front end portion of the locking arm from colliding with the columnar projections as the locking arm is raised up by the first connector's first latching protrusion is provided between the columnar projections and the front end portion of the locking arm.

3. The electric connector according to claim 1, wherein one pair of ends of the mating sensing member's first and second fingers is connected by a connecting part, the other ends are formed in a U-shape as free extremities, and the connecting part serves as a push-in manipulation part.

4. The electric connector according to claim 3, wherein the stopper engaging portions of the first and second fingers are formed as concavities of a size that enables the second connector's stopper projections to enter therein, and the first stopper strikes against the interior sidewalls of the concavities.

5. The electric connector according to claim 1, wherein the locking arm's pushing portions and the mating sensing member's actuation portions are each formed with inclined faces of particular angles.

* * * * *